US006767504B2

(12) United States Patent
Hattori et al.

(10) Patent No.: US 6,767,504 B2
(45) Date of Patent: Jul. 27, 2004

(54) HEAT TREATMENT FURNACE

(75) Inventors: Kiyoyuki Hattori, Osaka (JP); You Ishii, Osaka (JP); Toshiyuki Harada, Tenri (JP)

(73) Assignee: Koyo Thermo Systems Co., Ltd., Tenri (JP)

( * ) Notice: Subject to any disclaimer, the term of this patent is extended or adjusted under 35 U.S.C. 154(b) by 87 days.

(21) Appl. No.: 10/122,144

(22) Filed: Apr. 15, 2002

(65) Prior Publication Data

US 2002/0153073 A1 Oct. 24, 2002

(30) Foreign Application Priority Data

Apr. 17, 2001 (JP) ..... 2001-118392

(51) Int. Cl.[7] ..... C21B 7/24

(52) U.S. Cl. ..... 266/81; 266/89; 266/250; 266/252

(58) Field of Search ..... 266/81, 252, 250, 266/44, 89; 148/206

(56) References Cited

U.S. PATENT DOCUMENTS 4,807,853 A * 2/1989 Murakami et al. ..... 266/81
5,002,009 A * 3/1991 Hayami et al. ..... 266/252

FOREIGN PATENT DOCUMENTS

JP 36219252 A * 8/1987 ..... 266/252
JP 362192526 A * 8/1987 ..... 266/252

* cited by examiner

*Primary Examiner*—Scott Kastler
(74) *Attorney, Agent, or Firm*—Armstrong, Kratz, Quintos, Hanson & Brooks, LLP

(57) ABSTRACT

In a heat treating method and furnace used in this method which can prevent disturbance of an atmosphere gas inside a heat chamber, and can prevent deterioration of the processing quality and efficiency of work, a control section 4 first operates a vacuum pump VP to reduce the inner pressure of a purge chamber 3 to a predetermined pressure level, then manipulates a large and small caliber operating valve (13*a*, 13*b*) to supply the atmosphere from the interior of the heat chamber 1 to that of the purge chamber 3, and the control section 4 actuates transporting means 5 to transport the work W between the purge chamber 3 and the heat chamber 1 in a state wherein the inner pressures of the purge chamber 3 and the heat chamber 1 have been rendered substantially equal on the basis of detected values from first and second pressure sensors PS1, PS2.

2 Claims, 1 Drawing Sheet

HEAT TREATMENT FURNACE

BACKGROUND OF THE INVENTION

1. Field of the Invention

The present invention relates to a method for heat-treating work in a predetermined atmosphere, and a heat treatment furnace used directly for carrying out this method.

2. Description of the Related Art

In heat treatment furnaces, typically such as continuous furnaces, used for processes such as carburizing steel parts, purge chambers, to which a purge gas such as an inert gas is supplied, are provided at the entrance and exit sides of a heat chamber, to which a predetermined process gas atmosphere such as CO or $N_2$ is supplied, to isolate the inside of the heat chamber from the outside, thus improving the working environment and degree of safety, and moreover, stabilizing the atmosphere inside the heat chamber.

However, in a conventional heat treatment method and furnace such as the above, the inert gas inside the purge chamber has been known to break into the interior of the heat chamber when, for example, work is being transported from the entrance side purge chamber to the heat chamber, thereby disturbing the atmosphere inside the heat chamber so as to generate reduction of the concentration and partial pressure of the gaseous species of the atmosphere inside the heat chamber. As a result, problems have arisen in that work cannot be processed under the desired process conditions, leading to a deterioration of quality of the work being processed, or in that additional time is required to allow for the interior of the heat chamber to stabilize to the aforementioned process conditions, resulting in a deterioration in the process efficiency.

SUMMARY OF THE INVENTION

In consideration of the aforementioned problems with conventional art, an object of the present invention is to provide a heat treatment method and a heat treatment furnace employed in this method, which can prevent the occurrence of disturbance of the atmosphere inside a heat chamber, hence to prevent a deterioration of quality of the work being processed and process efficiency.

One aspect of the present invention is a heat treatment method for heating work inside a heat chamber supplied with a predetermined process gas atmosphere, while the interior of said heat chamber is isolated from outside air by means of a hermetically sealable purge chamber, wherein:

- the inner pressure of said purge chamber is reduced to a predetermined pressure level;
- said process gas atmosphere is supplied to the interior of thus evacuated purge chamber so as to backfill the inner pressure of this purge chamber substantially equal to the inner pressure of the heat chamber; and
- said work is transported between the purge chamber and the heat chamber under the equalized pressure.

In the aforementioned heat treatment method, an atmosphere which is the same as that of the heat chamber is supplied to the interior of the purge chamber which has been pumped down to a predetermined pressure level, and by means of this atmosphere the inner pressure of the purge chamber is rendered substantially equal to that of the heat chamber, whereupon work is transported from one to the other. Thus, fluctuations of the concentration, pressure, and the like, of the atmosphere inside the heat chamber are suppressed to a great extent, and disturbance to the atmosphere can be prevented.

It is desirable in the aforementioned heat treatment method that the atmosphere is supplied gradually from the interior of the heat chamber to the interior of the evacuated purge chamber to render the inner pressure of the purge chamber and the inner pressure of the heat chamber substantially equal. In so doing, fluctuations of the pressure inside the heat chamber can be further reduced.

Another aspect of the present invention is a heat treatment furnace specifically suited to perform the method of the present invention as aforementioned.

DESCRIPTION OF THE PREFERRED EMBODIMENTS

Figure 1:
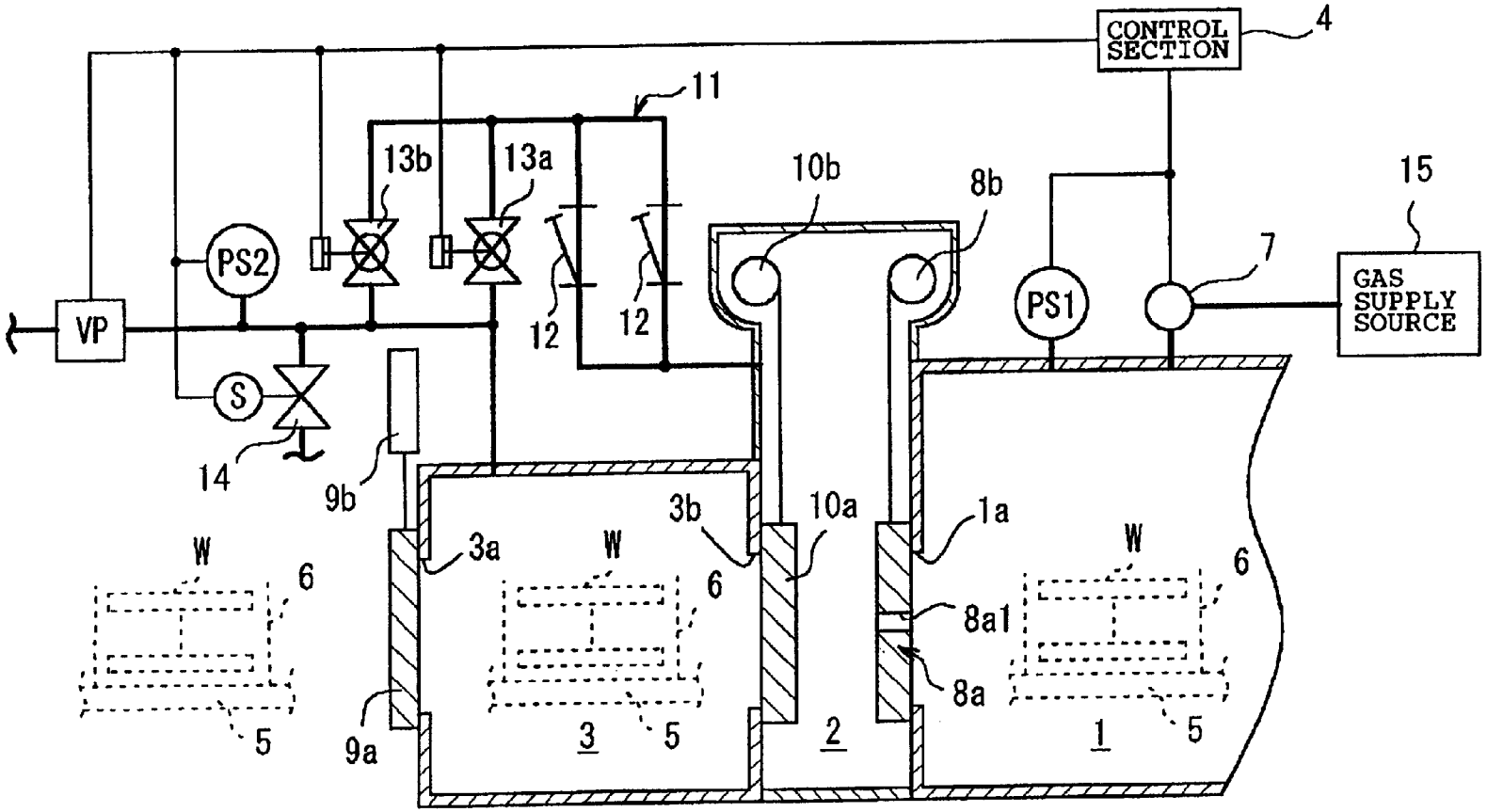
FIG. 1 is a schematic drawing showing an example of the main part of the heat treatment furnace in accordance with one embodiment of the present invention.

In the following, preferred embodiments of the heat processing method and furnace of the present invention will be explained with reference to the drawing.

FIG. 1 is a schematic drawing showing an example of the main part of the heat treatment furnace in accordance with one embodiment of the present invention. In order to simplify the following explanation, only the constitution of the entrance side of the heat treatment furnace will be explained. Further, the heavy lines in the figure indicate the gas circuit piping, whereas all other lines indicate control lines. In FIG. 1, the heat treatment furnace of this embodiment comprises: a heat chamber 1 for heating work W; a charge comprising one or more workpieces to be best treated, a purge chamber 3, installed alongside this heat chamber 1 with an intervening conjoining chamber 2 interposed therebetween, for isolating the interior of the heat chamber 1 from the outside air; a control section 4 for controlling each part of this device; and transporting means 5 for transporting work W from outside, via the purge chamber 3 and the conjoining chamber 2, into the heat chamber 1. This transporting means 5 is typically constituted by a roller conveyor, in which rotation of each roller is driven in accordance with instruction signals from the control section 4 to move a basket 6 in which work W is stored.

The interior of the heat chamber 1 is in communication with atmosphere supply means 7, which supplies process gas including gases such as CO and/or $N_2$ gas of a predetermined concentration from a gas supply source 15 to the heat chamber 1 on the basis of instruction signals from the control section 4, and with a first pressure sensor PS1, which detects the inner pressure of the heat chamber 1 and outputs thus detected value to the control section 4. The heat chamber 1 is also provided with a heater (not shown) which regulates heat by means of the control section 4, and hence the work W is heat processed under desired conditions, in a state in which the aforementioned atmosphere has been supplied. A door 8*a* is attached to the entrance 1*a* of the heat chamber 1. This door 8*a* is raised and lowered, and thereby opened and closed, by driving section 8*b*, which operates on the basis of instruction signals from control section 4, and thus the entrance 1*a* is opened only when work W is being transported. Furthermore, a connecting hole 8*a*1 is provided in the door 8*a* to permit the flow of the atmosphere by establishing communication between the heat chamber 1 and the conjoining chamber 2.

A front door 9*a* and a back door 10*a* for sealing the purge chamber 3 are attached respectively to the carry-in opening 3*a* and the carry-out opening 3*b* of the purge chamber 3. The front door 9*a* and the back door 9*b* are raised and lowered, and thereby opened and closed, by driving sections 9*b* and 10*b* respectively, which operate on the basis of instruction signals from control section 4.

Further, the interior of this purge chamber 3 is connected to the conjoining chamber 2 by means of piping 11 so that the same atmosphere as that of the heat chamber 1 can be appropriately supplied. More concretely, a strainer 12 for removing soot and the like from the atmosphere, and a large-caliber operating valve 13*a* and a small-caliber operating valve 13*b*, which are coupled together in parallel with each other, are attached to the piping 11, and upon operation of the large-caliber operating valve 13*a* and the small-caliber operating valve 13*b* in accordance with instruction signals from the control section 4, the atmosphere from the interior of the heat chamber 1 is supplied to the interior of the purge chamber 3. The piping 11, the large-caliber operating valve 13*a* and the small-caliber operating valve 13*b* form the purge gas supply means for supplying the same atmosphere as that inside the heat chamber 1 to the interior of the purge chamber 3.

Further, a second pressure sensor PS2 for detecting the inner pressure of the purge chamber 3 and outputting thus detected value to the control section 4, and a vacuum pump VP and an operating valve 14, both of which are operated by the control section 4, are connected to the purge chamber 3 via the aforementioned piping 11. This vacuum pump VP forms the means for pumping down the purge chamber 3 to a predetermined pressure level. The operating valve 14 operates in accordance with instruction signals from the control section 4 to connect the purge chamber 3 to the outside, and backfill the interior of the purge chamber 3 with outside air. The aforementioned large-caliber operating valve 13*a*, small-caliber operating valve 13*b* and operating valve 14 are formed by control valves such as solenoid valves and/or pneumatic valves.

In the heat treatment furnace of this embodiment, constituted as above, the control section 4 actuates the transporting means 5 to transport work W from outside of the device to the interior of the purge chamber 3, whereupon the purge chamber 3 is hermetically sealed by the front door 9*a* and the back door 10*a*. Then, the control section 4 operates the vacuum pump VP to reduce the inner pressure of the purge chamber 3 to a predetermined pressure level (in the order of 133 Pa, for example) on the basis of a, detected value from the second pressure sensor PS2. In so doing, the air inside the purge chamber 3 can be substituted for the aforementioned atmosphere more certainly.

Subsequently, the control section 4 actuates the small-caliber valve 13*b* such that the atmosphere is gradually supplied from the interior of the heat chamber 1 to the interior of the purge chamber 3 via the strainer 12. Thus, since the control section 4 forces the atmosphere to be supplied from the interior of the heat chamber 1 to the interior of the purge chamber 3 gradually, fluctuations in the pressure inside the heat chamber 1 can be further reduced.

Once the control section 4 has detected, on the basis of the respective measured values from the first and second pressure sensors PS1, PS2, that the inner pressure of the purge chamber 3 is approaching the predetermined range with respect to the inner pressure of the heat chamber 1, the control section 4 also actuates the large-caliber operating valve 13*a* until the inner pressure of the purge chamber 3 and the inner pressure of the heat chamber 1 become substantially equal. Once the respective inner pressures have become substantially equal, the control section 4 brings the large-caliber valve 13*a* and the small-caliber valve 13*b* to their closed-off states.

Then the control section 4 actuates driving sections 8*b* and 10*b* to open the door 8*a* and the back door 10*a* respectively, whereupon transporting means 5 is actuated so as to transport the work W from the purge chamber 3 to the heat chamber 1. Next, the control section 4 actuates driving sections 8*b* and 10*b* to close the door 8*a* and the back door 10*a* respectively, thereby hermetically sealing the purge chamber 3. Once the inner pressure of the purge chamber 3 has been reduced by the control section 4 to a predetermined pressure level in the above manner, the control section 4 manipulates the operating valve 14 to backfill the interior of the purge chamber 3 by means of outside air.

As explained above, in the heat treatment method and furnace of this embodiment, the large-caliber valve 13*a* and the small-caliber valve 13*b* are operated by the control section 4 to supply the process gas atmosphere from the heat chamber 1 to the interior of the purge chamber 3, the inner pressure of which has been reduced to a predetermined pressure level by operation of the vacuum pump VP by the control section 4. The control section 4 also actuates transporting means 5 to transport work W from the purge chamber 3 to the heat chamber 1 in a state in which the inner pressure of the purge chamber 3 and the inner pressure of the heat chamber 1 have been rendered substantially equal by means of the aforementioned atmosphere on the basis of respective detected values from the first and second pressure sensors PS1, PS2, and thus, fluctuations of the concentration, pressure and so on of the atmosphere inside the heat chamber 1 during transportation of the work can be suppressed to a great extent, whereby the generation of disturbance in the atmosphere inside the heat chamber 1 can be prevented.

In the above explanation, a constitution by which the atmosphere inside the heat chamber 1 is supplied to the interior of the purge chamber 3 using a large-caliber valve 13*a* and a small-caliber valve 13*b* was explained. However, the present invention is not limited thereto. The atmosphere may also be supplied to the interior of the purge chamber 3 by, for example, providing a single control valve between the aforementioned gas supply source 15 and the purge chamber 3, the opening of which is adjusted by the control section 4 on the basis of respective detected values from the first and second pressure sensors PS1, PS2.

Also, in the above explanation, only the constitution of the entrance side of the heat treatment furnace was explained. However, the aforementioned purge chamber 3, the purge gas supply means, and so on, are similarly provided alongside the aforementioned heat chamber 1, on the exit side of this furnace such that the occurrence of disturbance in the atmosphere inside the heat chamber 1 is prevented.

In accordance with the heat treatment method of the present invention as described above, fluctuations in the concentration, pressure and so on of the atmosphere inside the heat chamber during transportation of work can be suppressed to a great extent, whereby the occurrence of disturbance in the atmosphere can be prevented. Thus, work may be processed immediately after transportation, without readjusting the interior of the heat chamber to the desired processing conditions. As a result, loss time is minimized, the work may be processed under the desired processing conditions, and deterioration of the quality of the work being processed and the loss of efficiency in work processing may be prevented.

Further, upon backfilling the inner pressure of the purge chamber substantially equal to the inner pressure of the heat chamber, since the atmosphere is supplied gradually from the interior of the heat chamber to the interior of the pressure-reduced purge chamber, pressure fluctuations inside the heat chamber can be further reduced.

According to the heat treatment furnace of the present invention, fluctuations of the concentration, pressure and so on of the atmosphere inside the heat chamber during transportation of work can be suppressed to a great extent, whereby the generation of disturbance in the atmosphere inside the heat chamber can be prevented, and thus work may be processed immediately after transportation, without readjusting the interior of the heat chamber to the desired processing conditions. As a result, loss time is minimized, the work may be processed under the desired processing conditions, and deterioration of the quality of work processing and the loss efficiency of processing may be minimized.

The purge gas supply means may also be equipped with an control valve for supplying said atmosphere from the interior of the heat chamber to the interior of the purge chamber gradually, then the pressure fluctuations inside the heat chamber can be further reduced.

Based on this disclosure, various other modifications, not discussed here, are also possible within the scope of the present invention.

What is claimed is:

1. A heat treatment furnace, comprising:

a heat chamber for heating work;

atmosphere supply means for supplying process gas to this heat chamber;

a hermetically sealable purge chamber, installed alongside said heat chamber, for isolating the interior of this heat chamber from outside air;

transporting means for transporting said work;

a first pressure sensor for detecting the inner pressure of said heat chamber;

a second pressure sensor for detecting the inner pressure of said purge chamber;

means for reducing the inner pressure of said purge chamber to a predetermined pressure level;

purge gas supply means for supplying the gas identical to said atmosphere to the interior of said purge chamber; and a control section for controlling said transporting means, said means for reducing the inner pressure of said purge chamber to a predetermined pressure level, and said purge gas supply means on the basis of detected values from said first and said second pressure sensors, wherein said control section actuates said transporting means such that said work is transported between said purge chamber and said heat chamber in a state in which said atmosphere has been supplied to the interior of said purge chamber, following the pump down thereof to a predetermined, by said purge gas supply means, thus rendering the inner pressure of the purge chamber substantially equal to the inner pressure of the heat chamber.

2. A heat treatment furnace according to claim 1, wherein said purge gas supply means comprises an control valve for supplying said atmosphere from the interior of said heat chamber to the interior of said purge chamber gradually.

* * * * *